US007398580B1

(12) United States Patent
Miller, III

(10) Patent No.: US 7,398,580 B1
(45) Date of Patent: Jul. 15, 2008

(54) DEVICE TO SECURE SHOE LACES

(76) Inventor: John T. Miller, III, 1467 Brittany Ct., Grants Pass, OR (US) 97527

( * ) Notice: Subject to any disclaimer, the term of this patent is extended or adjusted under 35 U.S.C. 154(b) by 0 days.

(21) Appl. No.: 11/386,311

(22) Filed: Mar. 21, 2006

(51) Int. Cl.
*A43C 7/00* (2006.01)

(52) U.S. Cl. ..... 24/712.6; 24/712.2

(58) Field of Classification Search ..... None
See application file for complete search history.

(56) References Cited

U.S. PATENT DOCUMENTS 1,190,724 A 7/1916 Chadwick
3,176,362 A 4/1965 Tames
3,473,198 A 10/1969 Meier
4,715,094 A 12/1987 Herdman
4,949,437 A 8/1990 Anderson
5,022,127 A 6/1991 Ang
5,402,589 A 4/1995 Lubrani et al.
5,649,342 A 7/1997 D'Andrade et al.
5,718,021 A 2/1998 Tatum
6,247,214 B1 6/2001 Hyde
6,260,246 B1 7/2001 Lampkins

*Primary Examiner*—Jack W. Lavinder

(57) ABSTRACT

A clamping device for keeping conventionally tied shoe laces from becoming untied. The device has a top frame that contacts the top of the shoe laces and a bottom frame that contacts the bottom of the shoe laces. These two frames clamp the lace on both sides of a conventionally tied shoe lace knot and are connected by a hinge. The two frames are secured together by a latch. This device secures both the lace tension on the shoe and the knot.

4 Claims, 12 Drawing Sheets

DEVICE TO SECURE SHOE LACES

RELATED APPLICATIONS

This patent application incorporates by reference to Invention Disclosure Document number 592606 dated Jan. 3, 2006 entitled Shoe Lace Grip.

FIELD OF THE INVENTION

The present invention relates to shoe laces and, more particularly, to a device that latches around conventionally tied shoe laces to keep the knot from coming untied.

BACKGROUND OF THE INVENTION

Keeping shoe laces tied has been a problem since shoe laces were introduced. Many people have resorted to tying shoe laces using double knots but the laces are still susceptible to coming untied. Shoe manufacturers are now introducing alternative forms such as velcro, zipper or elastic bands to keep shoes secure while eliminating the nuisance of untied laces. However, the majority of shoes still use common laces that come untied.

An untied shoe lace is a tripping hazard and in hazardous occupations such as law enforcement, fire fighting and the military; untied laces can have extreme consequences. Athletes and children are particularly susceptible to having their shoe laces come untied.

Several attempts have been made to develop devices that keep shoelaces tied. The prior art can be divided into two categories depending on the required tying technique. A conventionally tied knot is referencing a shoe lace that is tied in the traditional manner into a bow knot with the bow loop and lace end extending from both sides of the centered lace knot. This could include both single or double knots. The device is then applied to these tied laces. The devices requiring the modification of the tying technique requires anything from cutting the laces, threading the laces through holes or slots in the bottom or sides of a device or pushing the laces through one way gripping devices that don't let them loosen up. The wearer has to learn a new technique of tying to use these devices.

A successful device not only keeps the shoe lace knot from coming untied but also keeps the tension of the lace on the shoe. This can only be accomplished by gripping the entire group of laces on both sides of the knot.

The first two patents to discuss allow the device to be applied to a conventionally tied shoe lace without having to modify the tying technique. U.S. Pat. No. 4,949,437 consists of an elastic band and a rigid tab. The tab is placed on top of the knot and the elastic band is placed under. The elastic band is stretched from a relaxed state to a stretched state and locks into a slot. The tension on the elastic band grips the lace. U.S. Pat. No. 6,260,246 B1 retains the laces on both sides of the knot using two small clamps connected together by a flexible extension and is permanently retained by the shoe.

The following patents require the user to modify the tying technique. U.S. Pat. No. 3,473,198 consists of a folding enclosure device that requires a coin or similar narrow object to unlatch it. This device requires the laces to be threaded through two openings and then tied. The drawing shows a clown design for child appeal. U.S. Pat. No. 5,022,127 consists of a unitary base and cover that requires the laces to be threaded through holes in the bottom portion and then tied. The drawings indicate a "turtle" design for child appeal. U.S. Pat. No. 5,402,589 is a device consisting of a base and a top that clamps the laces. This device is attached to the tongue of the shoe and uses elastic bands to provide tension to the upper and lower jaws to clamp the lace. The drawings indicate an "alligator" design for child appeal. U.S. Pat. No. 5,649,342 includes a three piece device with a cover, a base and a hinge. This design requires the shoe lace to be fed through both sides of a slot and then tied. The drawings indicate a "teddy bear" design for child appeal. U.S. Pat. No. 4,715,094 consists of a top and bottom portion with two side walls forming an enclosure for a shoelace knot. It has two ribs with serrations to clamp the bow and string end. It requires the laces be threaded through two slots in the bottom portion before or after tying. U.S. Pat. No. 5,718,021 includes components similar to the other patents including holes to thread the laces through before tying and a latching cover. This design has at least seven pieces to construct including both metal and plastic components. U.S. Pat. No. 6,247,214 is similar to the prior mentioned patents with a cover, hinge and latch that requires the laces to be threaded through holes in the base before tying.

The shortcomings of the prior art are bulkiness, complexity, modifying the conventional tying method, multiple parts, appealing only to children, questionable effectiveness and difficulty in latching and unlatching.

The reason in the first place for an invention of a shoe lace gripping device is to keep the laces from coming untied and retain the lace tension on the shoe. Some of the prior art has questionable effectiveness as evidenced by their use of elastic bands for the tension method. Over time, they will lose their elasticity. The method of using the contact of an elastic band against the lace as a means of holding is not as effective as gripping teeth. Others use holes with one way gripping devices to keep the laces from pulling back through the device. This keeps the tension on the laces of the shoe constant but does not address the bow coming untied which is the larger problem. The device (U.S. Pat. No. 4,715,094) that requires the laces be threaded through slots in the bottom portion does not clamp the entire shoe lace on both sides of the knot. It only retains the bow and loose string end and doesn't secure the part of the lace that keeps the tension on the shoe. A successful device needs to grip the entire laces on both sides of the knot to secure the knot and the lace tension on the shoe. To be able to withstand the rigors of athletics including kicking balls without coming untied requires a very robust clamp and latch.

The prior art is made from plastic, elastic bands or metal. Some use a combination of the three resulting in an expensive and complex device to construct. The molded designs are simpler and more cost effective than the more complex multiple part devices.

Some of the previous designs are very large and intrusive to the wearer. It would limit the commercial appeal of having something so large and complex on a shoe. The designs that show clowns, bears, turtules, alligators, etc. in their drawings for decorative purposes would be very cumbersome and distracting to the wearer. Some of the previous designs are completely oriented toward kids and would not have broad appeal for adults. The design with the laces being threaded through slots in the bottom portion is drawn as a large, rectangular box which would be cumbersome.

Some of the prior art are easy to install and some are quite complicated. Nearly every design requires the conventional tying method to be modified to accommodate the gripping device. The only devices that do not require modifying the tying technique are the elastic band and tab apparatus and the device consisting of two small clamps that are locked on both sides of the knot. The elastic bands lose tension over time and do not grip as well as a toothed design. The device consisting of two small clamps would be difficult or impossible to latch over large, round laces and require two clamping devices to be separately attached to the laces instead of one making this device inconvenient to use. The device that requires feeding the lace strings up through slots in the bottom portion before or after tying would require some finesse to install properly.

The present invention accommodates conventional single or double knot tying without having to modify the tying technique, is compact, works with any shoe lace thickness, requires only one clamping device be installed, appeals to kids and adults alike with space for themes of interest to the wearer, unquestionably keeps the laces tied and is easy to latch and unlatch overcoming all previous shortcomings in one unit. The device will be referenced as the "grip" throughout the description.

It is therefore an object of the invention to attach to a conventionally tied shoelace without having to modify the tying technique.

It is another object of the invention to grip all the laces on both sides of the knot so the lace tension on the shoe and the knot are secure.

It is another object of the invention to be very lightweight and unintrusive so as not to encumber the wearer.

It is another object of the invention to provide a tooth design that intermeshes the top and bottom teeth firmly grabbing the lace.

It is another object of the invention to provide a latching mechanism that can be easily squeezed open or shut by adults and children alike.

It is another object of the invention to provide an open center that uses the lace knot to keep the device centered while accommodating both single and double knotted laces.

It is another object of the invention to offer an area over the latch and the frame perimeter to promote themes such as trademarks, sports teams, etc improving the appeal of the unit.

SUMMARY OF THE INVENTION

In accordance with the present invention, there is provided a clamping device for keeping conventionally tied shoe laces from coming untied and for holding the tension of the shoe laces on the shoe. The device has a top frame that contacts the top of the shoe laces and a bottom frame that contacts the bottom of the shoe laces. These two frames clamp the laces on both sides of the conventional shoe lace knot and are connected by a hinge. The two frames are secured together by a latch.

BRIEF DESCRIPTION OF THE DRAWINGS

A complete understanding of the present invention may be obtained by reference to the accompanying drawings, when considered in conjunction with the subsequent, detailed description, in which:

FIG. 4 is an open interior view of a grip viewing the portion the shoe laces are clamped with;

For purposes of clarity and brevity, like elements and components will bear the same designations and numbering throughout the Figures.

DESCRIPTION OF THE PREFERRED EMBODIMENT

The clamping device for keeping conventionally tied shoe 32 laces from coming untied consists of a top frame 14 and a bottom frame 10 that is slid under and over the lace knot 34 and latched together. The lace knot 34 is now secure. The lace knot 34 remains tied until the wearer is ready to remove their shoes at which time they simply unlatch and separate the two frames from around the knot. This device does not stay with the shoe 32 but can be transferred to other shoes.

Figure 1:
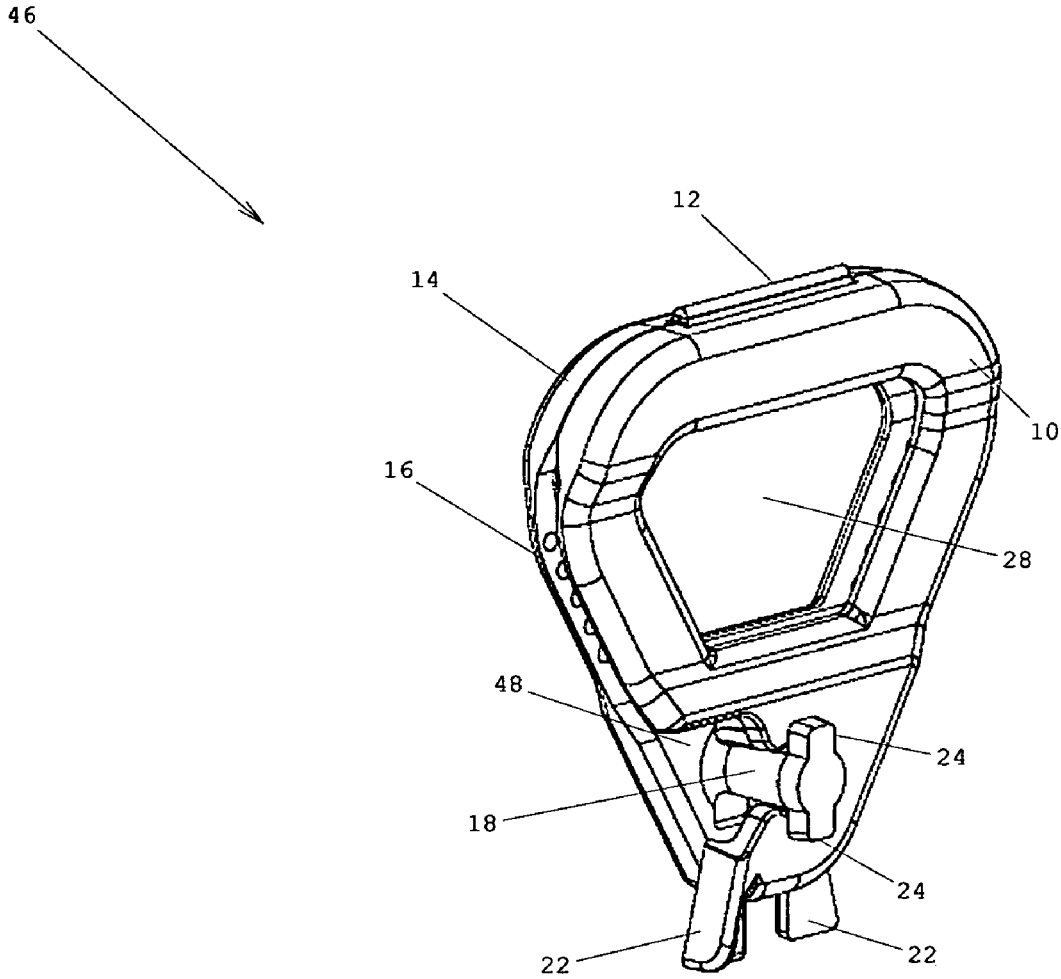
FIG. 1 is a bottom perspective view of a grip in the latched position.

FIG. 1 is a bottom perspective view showing the device in the latched position. The device will hereafter be referenced as the grip 46. The grip 46 comprises a top frame 14 and a bottom frame 10 connected by a hinge 12. The grip 46 is opened by squeezing the unlatching tabs 22 horizontally toward each other allowing the two frames 10 and 14 to be pulled vertically apart. The bottom frame 10 is pushed under a conventionally tied lace knot 34 and the top frame 14 goes over the lace knot 34 with the gripping teeth set 16 contacting the lace 40 on both sides of the lace knot 34. The two frames are then pushed horizontally together snapping the latching post 18 into the latch slot 20. The teeth set 16 on the top frame 14 and the bottom frame 10 grips the lace 40 and prevents the lace knot 34 from coming untied. The opening 28 provides space for a single or double lace knot 34 to reside. The hold down tabs 24 keeps the lace 40 from pushing the frames apart.

Figure 2:
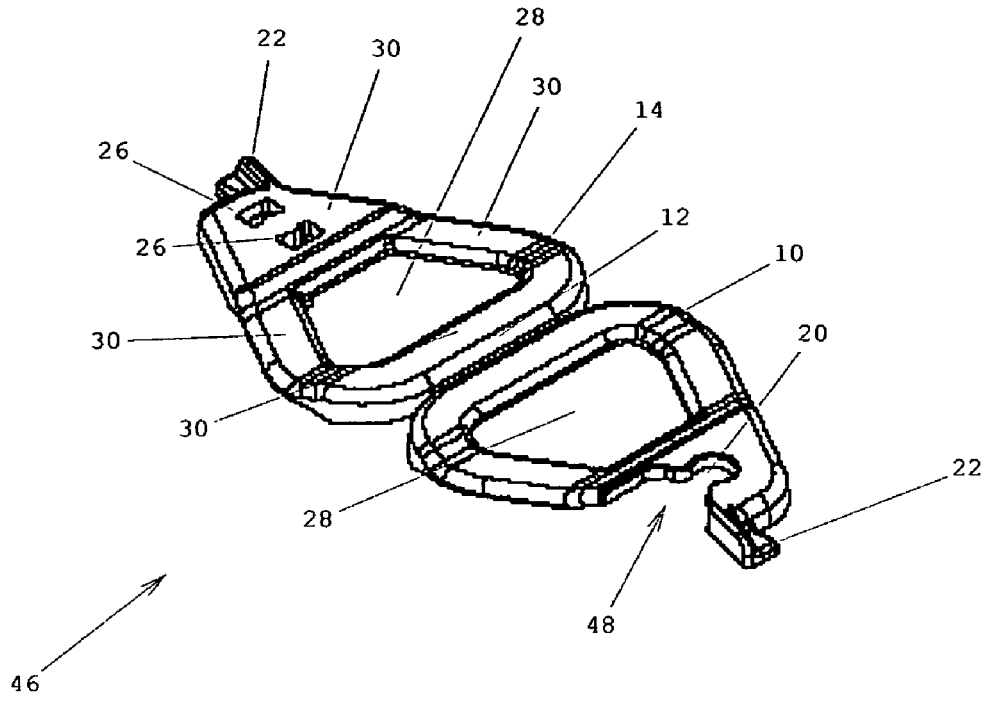
FIG. 2 is an unlatched exterior perspective view of a grip in the molded position.

FIG. 2 is an unlatched perspective view showing the grip 46 in it's molded position. This view shows the latch slot 20 which is the receiver for the latching post 18 to latch into. Note the opened center section to accommodate the lace knot 34 and the holes for molding 26 to allow formation of the hold down tabs 24 during the molding process. The cutout area 48 is necessary to allow the hold down tabs 24 to clear the bottom frame 10 during latching and unlatching.

Figure 3:
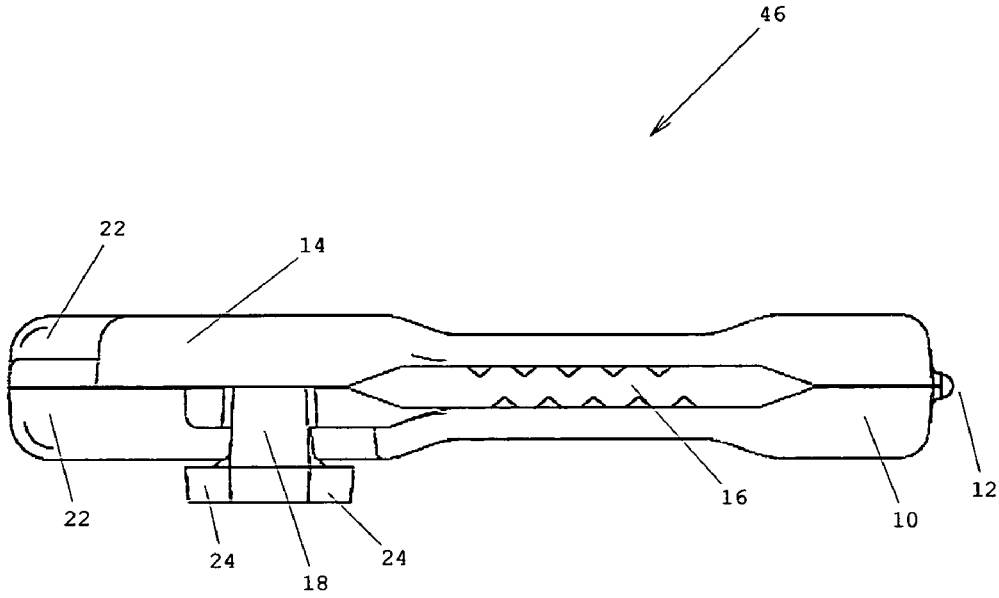
FIG. 3 is a latched cross sectional view of a grip with the latch in the closed position.

FIG. 3 is a latched cross sectional view showing the details of the intermeshing teeth set 16 that grips the lace 40 and a cross section of the latch in the closed position. The top frame 14 and the bottom frame 10 are connected by the hinge 12.

Figure 4:
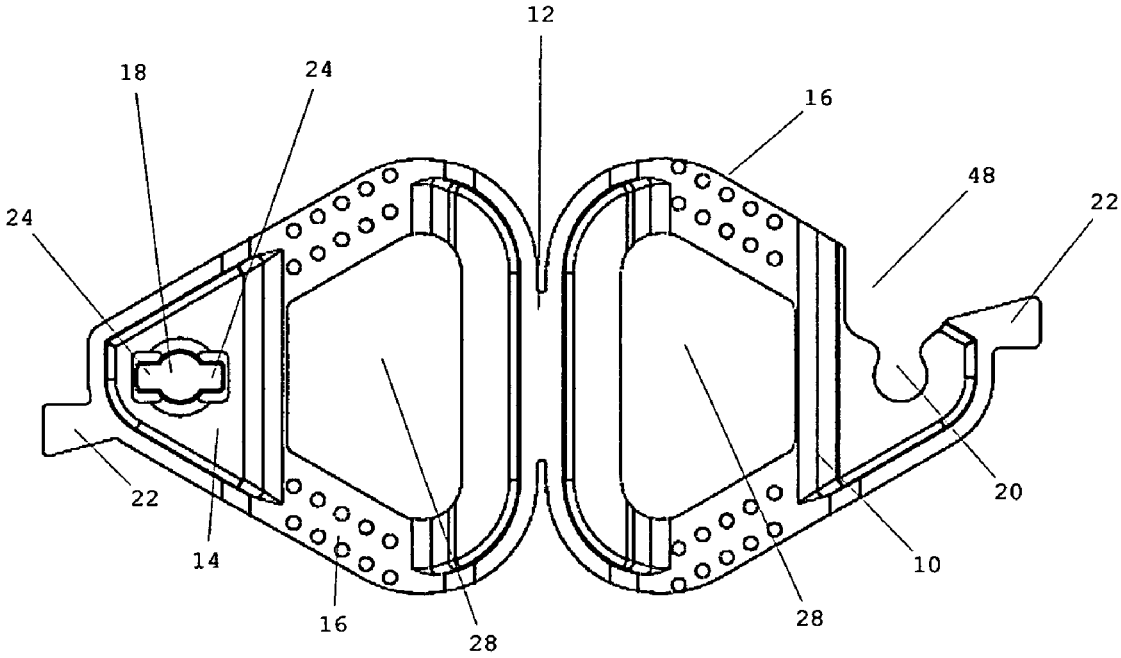

FIG. 4 is an interior view of the grip 46 in the open position showing the contact area of the lace 40. It details the intermeshing teeth set 16 and the unlatching tabs 22 on the ends which are squeezed horizontally to unlatch the frames 10 and 14.

Figure 5:
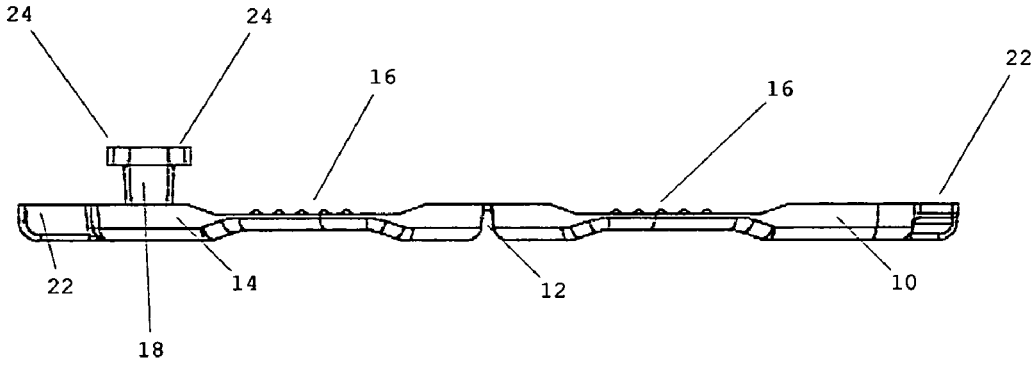
FIG. 5 is a side profile in the open position view of a grip with the lace contact area on both sides facing up.

FIG. 5 is a side profile of the grip 46 opened with the lace 40 contact area on both frames facing up detailing the latching post 18 on the left end and the side profile of the unlatching tabs 22.

Figure 6:
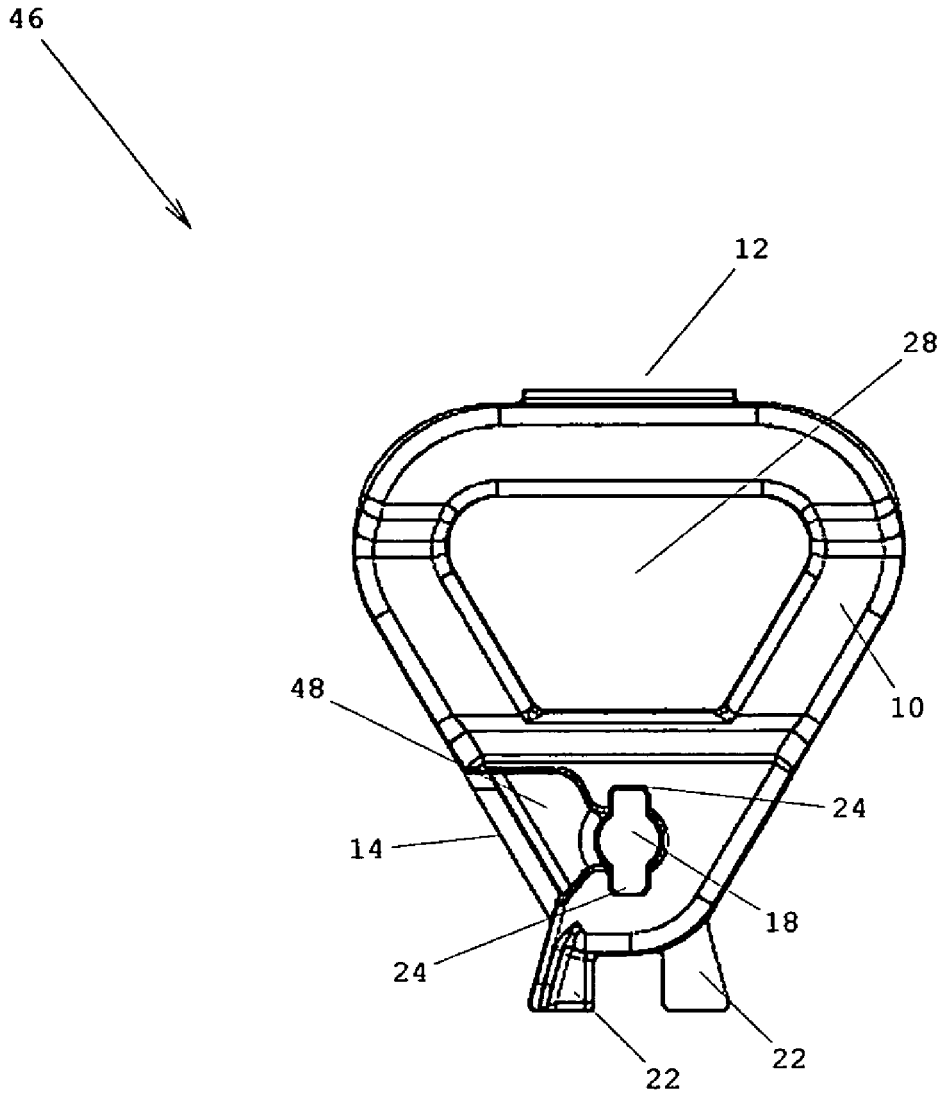
FIG. 6 is a bottom perspective view of a grip latched with the latching post snapped into the latch slot in the bottom frame.

FIG. 6 is a bottom perspective view showing the grip 46 latched with the latching post 18 snapped into the latch slot 20. Note the offset of the unlatching tabs 22 on the ends of the frame 10 and 16 such that squeezing them together will snap the latching post 18 out of the latch slot 20 and unlatch the two frames so they can be pulled apart releasing the lace 40.

Figure 7:
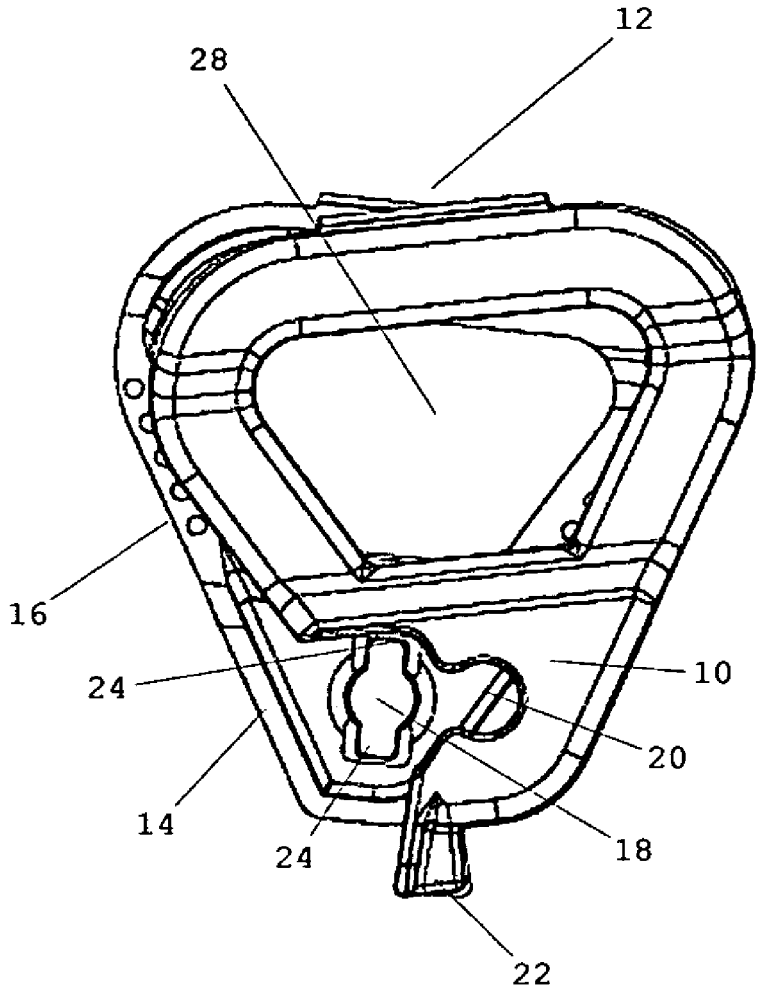
FIG. 7 is a bottom perspective view of a grip unlatched.

FIG. 7 is a bottom view detailing the grip 46 unlatched. The bottom frame 10 has been pushed in the opposite direction to the top frame 14 far enough to disengage the latching post 18 from the latch slot 20. The hinge 12 is flexible enough to withstand this side force of latching and unlatching the grip 46. The cutout area 48 is clearly necessary to allow the hold down tabs 24 to clear the bottom frame 10 when opening the grip 46.

Figure 8:
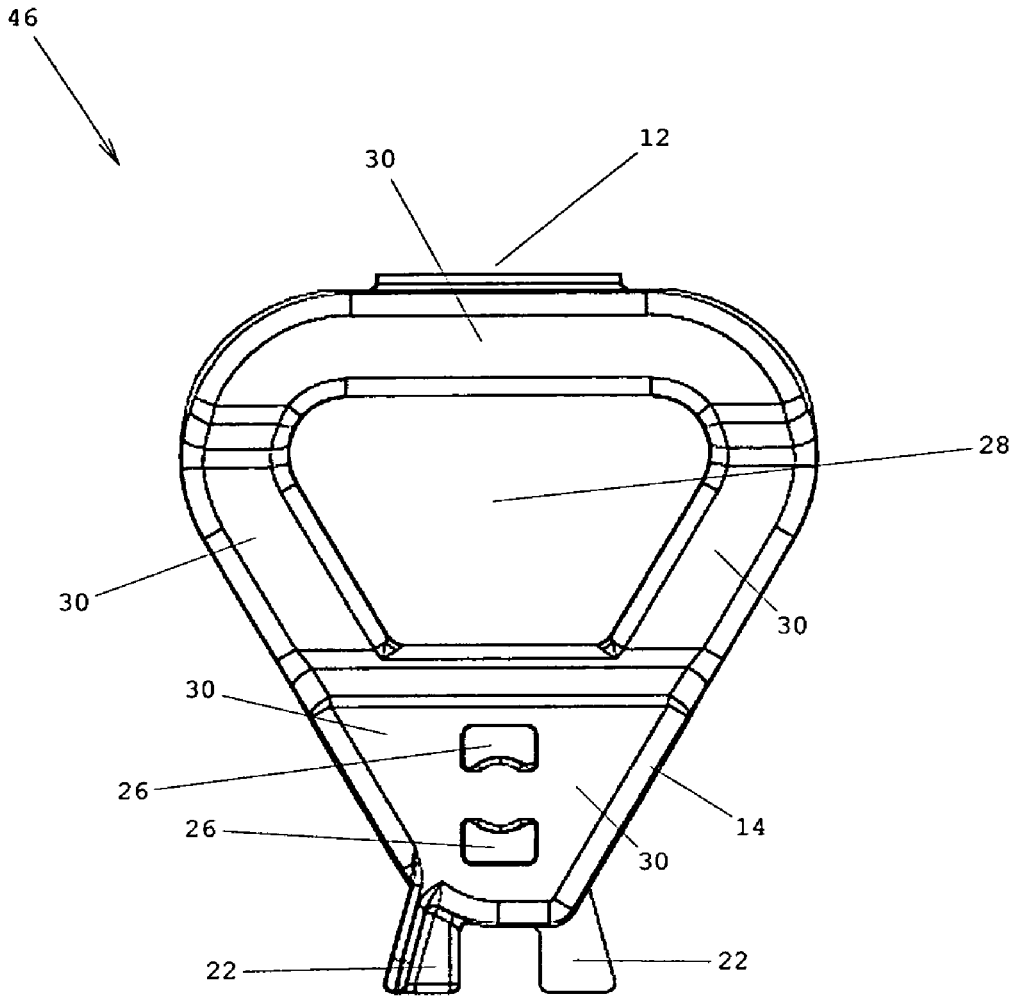
FIG. 8 is a top latched view of a grip as viewed by the wearer.

FIG. 8 is a latched view of a grip 46 as seen by the wearer. Note the marketing space 30 that includes the perimeter area around the opening and the area over the holes for molding 26. An adhesive sticker or paint with various themes of interest to the wearer is applied to the grip 46.

Figure 9:
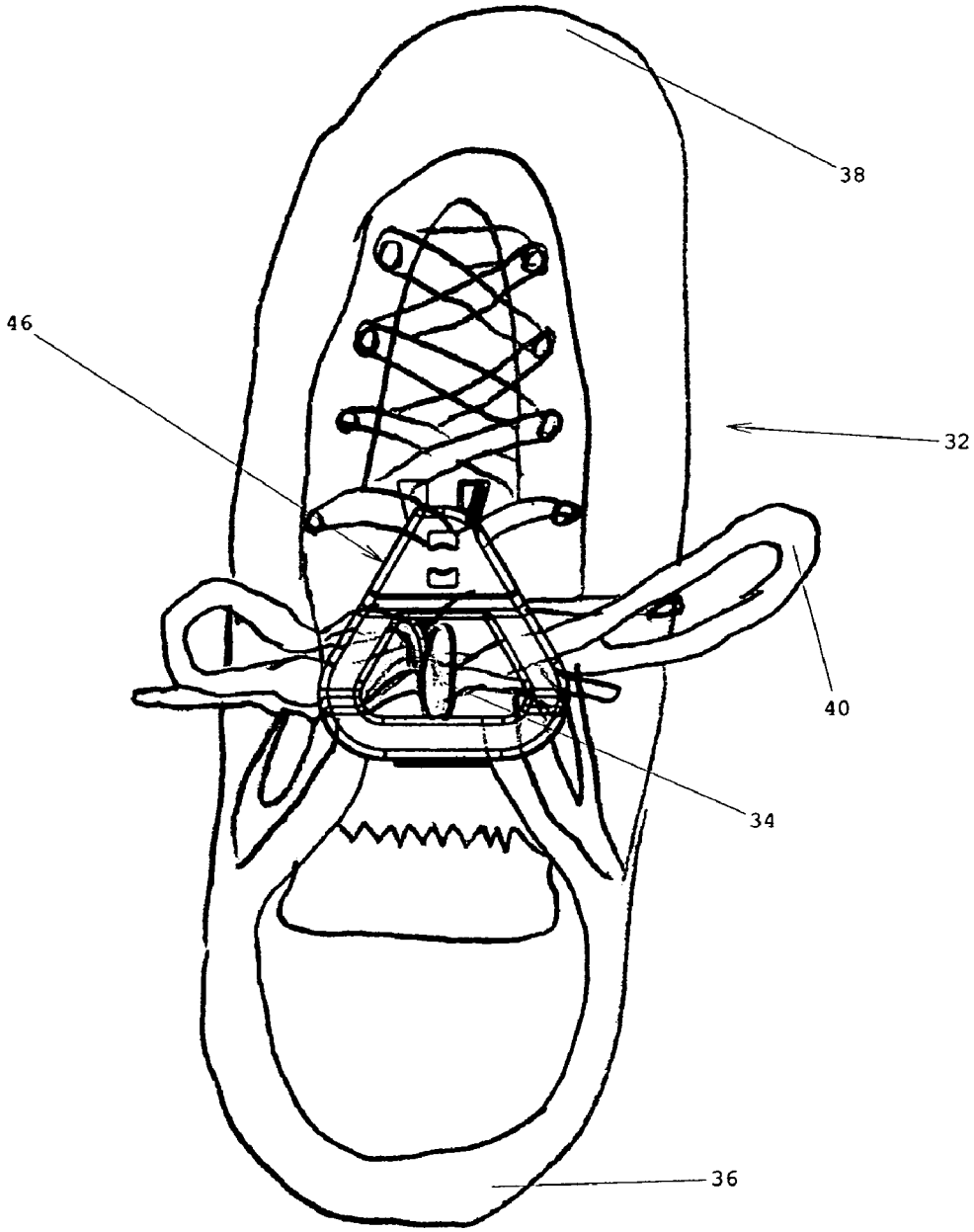
FIG. 9 is a top view of a grip attached to a shoe lace knot with the latch facing toward the toe of the shoe.

FIG. 9 is a view of a grip 46 attached to a shoe 32 with the unlatching tabs 22 facing toward the toe 38 of the shoe 32. The wearer ties the lace 40 into a bow knot, slides the bottom frame 10 under the lace knot 34 and the top frame 14 over the lace knot 34 with the hinge 12 toward the heel of the shoe 32. The two sides are pushed horizontally in opposite directions far enough for the latching post 18 to clear the cutout area 48 in the bottom frame 10 and are pushed back horizontally locking the latching post 18 into the latch slot 20. The lace knot 34 in the opening keeps the grip 46 centered.

Figure 10:
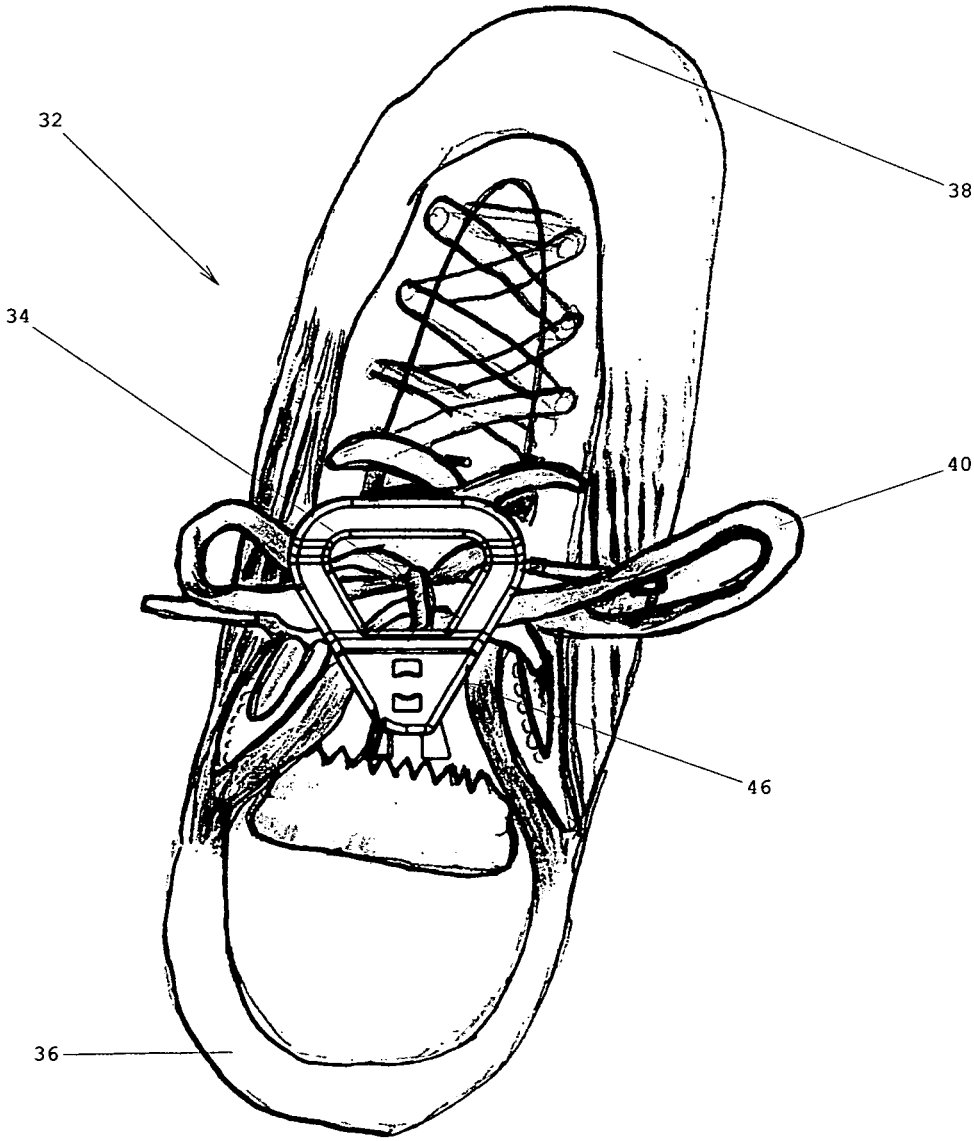
FIG. 10 is a top view of a grip attached to a shoe lace knot with the latch facing toward heel.

FIG. 10 is a view of a grip 46 attached to a shoe 32 with the unlatching tabs 22 facing toward the heel of the shoe 32. The grip 46 is installed as described in the description of FIG. 9. FIGS. 9 and 10 show alternative methods of installing the grip 46 depending on the wearer's preference.

Figure 11:
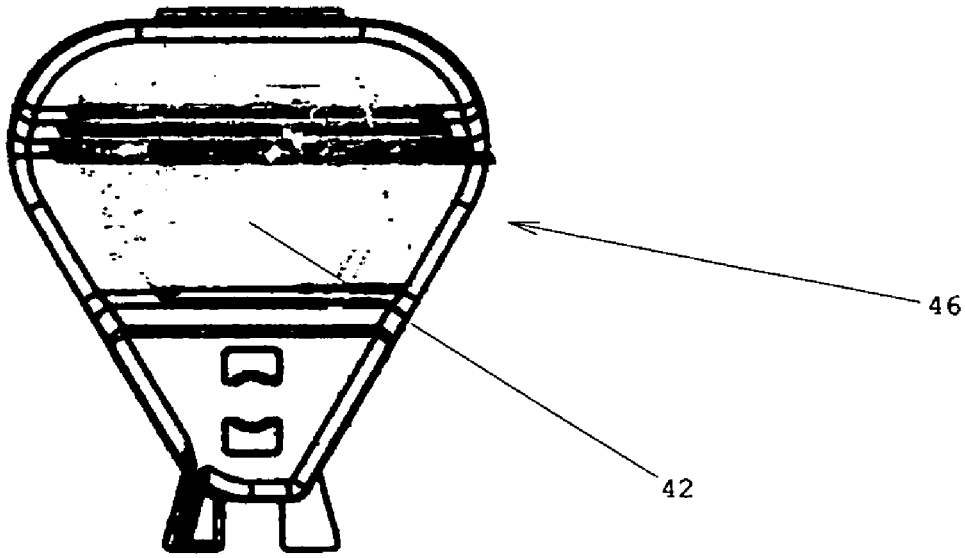
FIG. 11 is a top view of an alternate embodiment of a grip with the center opening removed.

FIG. 11 is an alternate embodiment view of the grip 46 less the opening 28. The center section of one or both frames could be solid instead of open.

Figure 12:
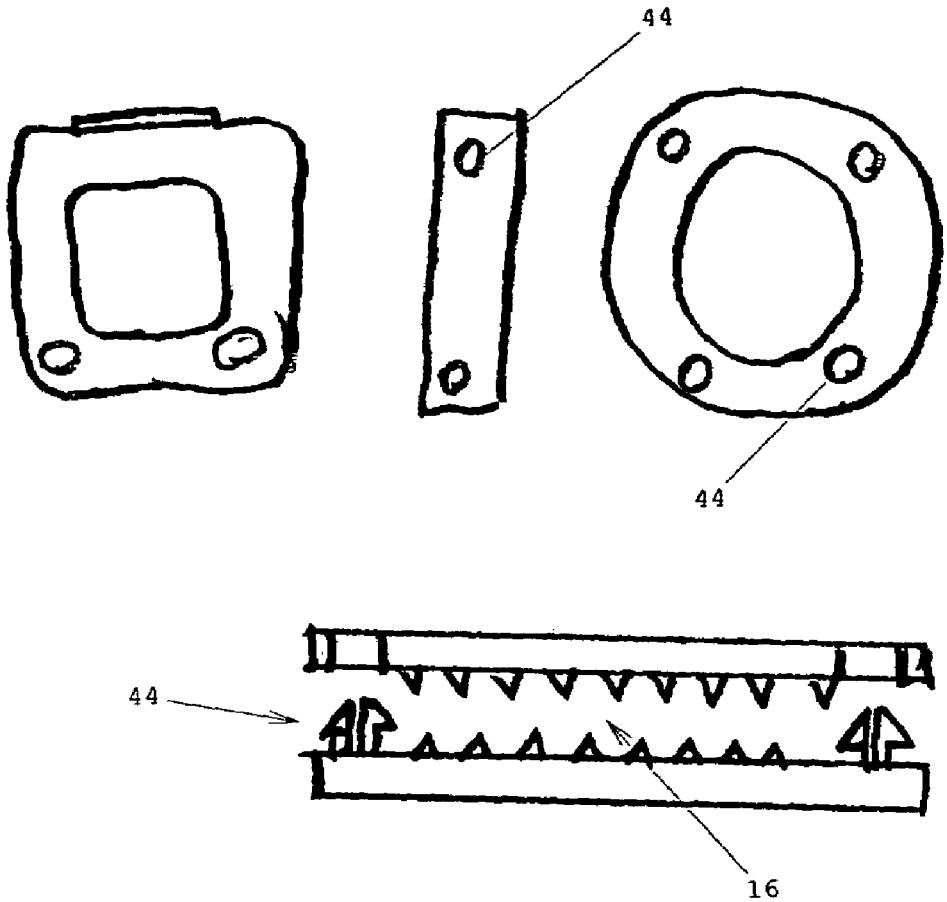
FIG. 12 is a top and side view of a grip showing different design options and the hinge removed and replaced by two snap together frames that clamp on both sides of the knot.

FIG. 12 shows some alternative embodiments of the grip 46 demonstrating the overall shape could be many different designs but the functionality remains of applying a clamping device to an previously tied shoe 32. The device could be made with two frames not attached by a hinge 12 that snap together on both sides of a conventionally tied lace knot 34. The device can be made from alternative materials such as metal or wood.

My preferred embodiment of this device is manufactured by injection molding either plastic, nylon or polypropylene material as a one piece unit as shown in FIG. 2 in it's molded position. This mold can be one cavity or multiple cavities depending on production requirements and is made from very hard metal for long life. The device can be manufactured by machining instead of molding. The device is made out of different color resins to accommodate the wearer's preference. The marketing sticker is applied to the perimeter of the device after the molding process is done and before packaging. This marketing theme can be painted on instead of using a sticker.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A device to secure shoe laces for preventing the laces from becoming untied, comprising:

a perimeter bottom frame, for gripping the underside of the shoe laces on both sides of a conventionally tied knot;

a perimeter top frame, for gripping the top side of the shoe laces on both sides of a conventionally tied knot;

a flexible hinge having a longitudinal axis connected to said top frame and to said bottom frame for allowing the frames to pivot about the longitudinal axis and to pivot in a direction about an axis that is transverse to the longitudinal axis;

a latching device comprising a pair of latching tabs and a hold down tab for holding the two frames together in a closed position.

2. The device to secure shoe laces as recited in claim 1, wherein said latching tabs are rigidly connected to said top and said bottom frame, respectively, for squeezing together to unlatch the latching device to allow the frames to pivot away from one another.

3. The device to secure shoe laces as recited in claim 1, further comprising:

a cutout area in the bottom frame, which allows said hold down tab to clear the bottom frame when the device is latched and unlatched.

4. A device to secure shoe laces for preventing the laces from becoming untied, comprising:

a perimeter bottom frame, for gripping the underside of the shoe laces on both sides of a conventionally tied knot;

a perimeter top frame, for gripping the top side of the shoe laces on both sides of a conventionally tied knot;

a flexible hinge having a longitudinal axis connected to said top frame and to said bottom frame for allowing the frames to pivot about the longitudinal axis and to pivot in a direction about an axis that is transverse to the longitudinal axis;

an opening in the top and bottom frame allowing the single or double knot to protrude;

a plurality of teeth rigidly connected to said top frame and a plurality of teeth rigidly connected to said bottom frame for gripping the shoe laces;

a latching device comprising a latching post, a latch slot, unlatching tabs, hold down tabs, and a cutout area for holding the two frames together in a closed position;

said latching post perpendicularly connected to said top frame for locking the top and bottom frames together when latched;

said latch slot rigidly connected to said bottom frame for holding the latching post in position when latched;

said latching tabs rigidly connected to said top and said bottom frame, respectively, for squeezing together to unlatch the latching device to allow the frames to pivot away from one another;

said hold down tabs, for holding the top and bottom frames together vertically when latched around a shoe lace;

said cutout area located in the bottom frame for allowing space for the latching tab to clear the bottom frame when latching and unlatching.

* * * * *